US006676321B2

(12) United States Patent
Gueret

(10) Patent No.: US 6,676,321 B2
(45) Date of Patent: Jan. 13, 2004

(54) PACKAGING AND APPLICATOR DEVICE

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/841,658

(22) Filed: Apr. 24, 2001

(65) Prior Publication Data

US 2002/0003983 A1 Jan. 10, 2002

(30) Foreign Application Priority Data

May 5, 2000 (FR) ..... 00 05794

(51) Int. Cl.[7] ..... A45D 33/00
(52) U.S. Cl. ..... 401/130; 401/126
(58) Field of Search ..... 401/130, 126, 401/118, 123, 127, 128, 129, 55, 82; 132/293, 294, 298

(56) References Cited

U.S. PATENT DOCUMENTS 1,362,808 A 12/1920 McFarland
1,375,938 A * 4/1921 Slack ..... 401/130
1,723,099 A * 8/1929 Van Sant ..... 401/130
1,744,191 A * 1/1930 Younghusband ..... 401/130
1,744,293 A * 1/1930 Younghusband ..... 401/130
3,871,390 A * 3/1975 Spatz ..... 401/130
5,636,931 A 6/1997 Gueret ..... 401/126
6,354,308 B1 * 3/2002 Kuk ..... 132/301

* cited by examiner

*Primary Examiner*—David J. Walczak
(74) *Attorney, Agent, or Firm*—Hunton & Williams LLP

(57) ABSTRACT

A packaging and applicator device of the type comprising an applicator having an application portion and a receptacle capable of being closed, the receptacle defining a first housing for the substance and a second housing which, in the closed position of the receptacle, receives the application portion of the applicator, the first and second housings communicating via an opening of cross-section that is substantially identical to that of the first housing, said opening enabling the application portion to be put into contact with the substance. The second housing defines a bearing surface around at least a portion of said opening so as to limit the pressure that can be exerted by the application portion on the substance when the receptacle is closed.

154 Claims, 3 Drawing Sheets

PACKAGING AND APPLICATOR DEVICE

The present invention relates to the field of devices for packaging and applying a substance, in particular a cosmetic or a care product.

BACKGROUND OF THE INVENTION

U.S. Pat. No. 1,362,808 discloses a device that includes an applicator comprising an application portion, and a receptacle capable of being closed and housing a supply of substance, the body of the receptacle also defining a housing for receiving the application portion of the applicator when the receptacle is closed. Means are provided for pressing the supply of substance against the application portion so as to fill it with the substance. In that known device, those means are constituted by a spring working in compression, the spring having one end bearing against the bottom of the body of the receptacle and having its other end urging the supply of substance towards the application portion of the applicator. A perforated disk is interposed between the supply of substance and the application portion, said disk merely being placed on the supply of substance and consequently being movable relative to the body of the receptacle.

Such a device is suitable for packaging and applying a substance that is relatively compact, but it is poorly suited to packaging a substance of more fluid consistency since, under the pressure exerted by the above-mentioned spring, such a substance can flow on coming into contact with the application portion and fill it in unsatisfactory manner.

OBJECTS AND SUMMARY OF THE INVENTION

The present invention seeks in particular to improve devices of the type including an applicator comprising an application portion and a receptacle defining a first housing for the substance and a second housing for receiving the application portion of the applicator when the receptacle is in the closed position, the first and second housings communicating with each other via an opening of cross-section that is substantially identical to that of the first housing, said opening enabling the application portion to be put into contact with the substance.

The invention seeks in particular to enable a dispersible substance of relatively fluid consistency to be packaged and applied.

The invention achieves this by the above-mentioned second housing defining a bearing surface around at least a portion of said opening in such a manner as to limit the pressure that can be exerted by the application portion on the substance when the receptacle is closed.

Thus, the invention limits the extent to which the application portion can be pushed into the supply of substance while the device is not being used, when the receptacle is closed and contact pressure exists between the substance and the application portion.

The operation of the device is therefore improved, in particular the quality in which the application portion is filled with substance.

In addition, the invention makes it possible to package a wider variety of substances since the application portion exerts a force on the supply of substance while the receptacle is closed, but said force is limited by the above-mentioned bearing surface and there is no fear of the supply of substance becoming deformed under the effect of contact pressure with the application portion.

The invention also makes it possible to control accurately the contact pressure between the application portion and the substance when taking up substance, since high levels of pressure can be generated only at the time of use, and only if the user so desires.

Advantageously, the application portion is elastically deformable.

In a particular embodiment, the above-mentioned bearing surface is annular in shape, surrounding the opening that puts the two housings into communication.

An annular bearing surface as described above then makes it possible to obtain a bearing surface of relatively large area for the application portion, e.g. so as to avoid locally compressing the application portion to such an extent as to cause it to lose its ability to return to its initial shape when extracted from the receptacle.

In a particular embodiment, the bearing surface in question is made integrally with the body of the receptacle, thus simplifying manufacture.

Advantageously, the bearing surface is concave in shape towards the application portion, and the application portion is preferably outwardly convex.

The bearing surface can thus fit substantially around a region of the application portion when the applicator is in place on the body of the receptacle.

Advantageously, the application portion is secured to a handle member which also constitutes a cover for closing the receptacle.

By way of example, such a cover can have an inside thread for screwing onto an outside thread on the body of the receptacle.

The contact pressure between the substance and the application portion can be exerted in various ways, at least in order to fill the application portion at the time of use.

Advantageously, the device includes a member that moves in such a manner as to cause relative displacement between the substance and the application portion.

In a particular embodiment, the member in question is movable relative to the body of the receptacle to drive the substance towards the application portion.

In a variant, this member is movable relative to the cover to drive the application portion towards the substance.

The moving member can be secured to a drive member that is movable relative to the body of the receptacle, and that co-operates therewith by screw engagement in such a manner that turning the drive member causes the moving member to move axially within the body of the receptacle.

In a particular embodiment, the above-mentioned drive member is directly accessible from outside the receptacle by the user and, for example, can be in the form of a button having at least one portion in relief on a visible face enabling it to be turned.

The moving member can also be driven axially by a drive mechanism that is more complex.

By way of example, such a drive mechanism comprises first and second portions that are movable relative to each other, the first portion having axial slots slidably receiving studs secured to the moving member, the second portion having at least one thread in which said studs engage, such that relative movement between the two portions is accompanied by axial displacement of the moving member.

The moving member can also be moved relative the body of the receptacle merely by the user exerting pressure on the elevator member.

Under such circumstances, the moving member is advantageously urged into an initial position by resilient return means.

The contact pressure of the application portion against the substance can also be obtained by means of the applicator.

Thus, the application portion can be made of an elastically deformable material such that when it is in place on the body of the receptacle and the receptacle is closed, it exerts a certain amount of contact pressure on the substance.

It is also possible to make the application portion with an application surface that is relatively rigid and to provide elastically deformable means on the applicator enabling the application portion to be urged towards the substance.

It is also possible to provide a spring on the applicator between the cover and the application portion or to secure the application portion on an elastically deformable member such as a piece of foam.

Advantageously, the body of the receptacle is arranged in such a manner as to enable the device to be refilled.

When the receptacle includes a moving member enabling the substance to be moved towards the application portion, said moving member is advantageously disposed in removable manner on the body of the receptacle.

Thus, in a particular embodiment, the moving member is secured to at least one fastener capable of being moved by the user to release the moving member from the body of the receptacle to allow a new supply of substance to be put into place.

The device can have resilient tabs that engage an inside thread on the body of the receptacle and that are suitable for being moved by the user when it is necessary to separate the moving member from the body of the receptacle.

The body of the receptacle can also include a removable or hinged bottom enabling a refill to be installed or replaced, such a refill comprising, for example, a supply of substance and a substance-carrier unit, said substance-carrier unit optionally including a dispenser mechanism enabling the substance to be moved towards the application portion.

The removable or pivoting bottom can include a central opening, e.g. enabling the user to actuate the substance-carrier unit to fill the application portion with substance or to reveal a mirror, the substance itself, a sample of substance, or information, e.g. concerning the color of the substance.

The invention applies to packaging and applying all types of dispersible substance whether in semisolid, gell, cream, or powder form.

In particular, the supply of substance can be in the form of a stick, cast or compacted directly in the body of the receptacle or fitted therein.

The receptacle is preferably closed in sealed manner.

The application portion can advantageously contribute to sealing closure of the receptacle.

The application portion can be secured to a handle member also constituting a cover for closing the receptacle or, in a variant, it can be movable or removable relative to the cover.

In general, sealing on closure of the receptacle can be obtained by any conventional means, for example by means of sealing lips present on the applicator and/or on the body of the receptacle, or by means of an elastomer gasket.

The substance can be brought into contact with the application portion via the opening that puts the two above-mentioned housings into communication, the application portion advantageously be dome-shaped with a section at the base that is greater than the section of said opening.

In a particular embodiment, the substance is delivered towards the application portion through a screen disposed in the above-mentioned opening, and that is movable relative to the body of the receptacle.

The application portion can comprise a foam having open or closed cells.

The application portion can be flocked, can be covered in a net, or in woven or non-woven cloth.

The application portion can have a plurality of elements of various kinds and/or structures, for example foams of different hardnesses, densities, and/or porosities.

The application portion can be washable with soap and water, which is advantageous when the device is used with refills containing different substances.

The application portion can be hydrophilic or hydrophobic.

BRIEF DESCRIPTION OF THE DRAWINGS

Other characteristics and advantages of the present invention will appear on reading the following detailed description of non-limiting embodiments and on examining the accompanying drawings, in which.

DETAILED DESCRIPTION

The device 1 shown in FIGS. 1 to 4 includes a receptacle comprising a body 2 and a cover 3.

The body 2 houses a supply of substance P, constituted by a stick of foundation in the example described.

Figure 1:
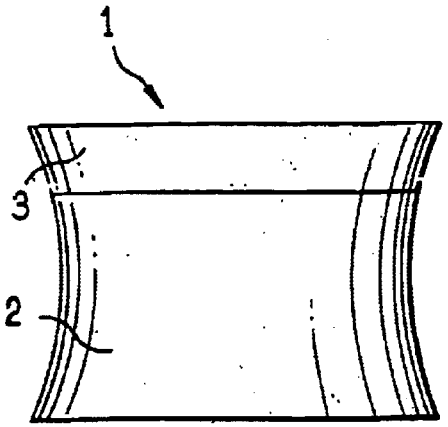
FIG. 1 is a diagrammatic elevation view of a device constituting a first embodiment of the invention.
Figure 2:
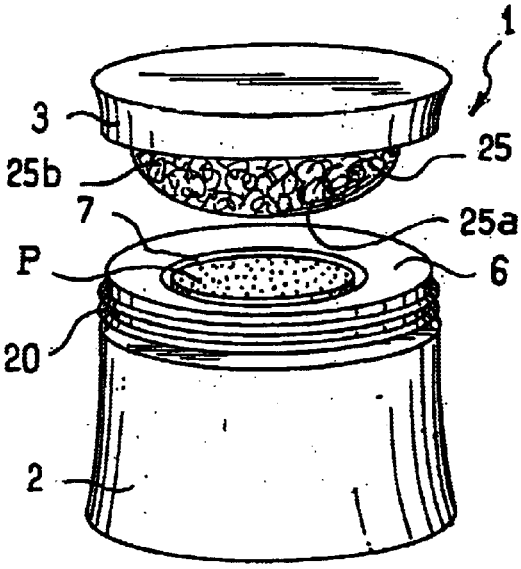
FIG. 2 shows the FIG. 1 device with the cover unscrewed.
Figure 3:
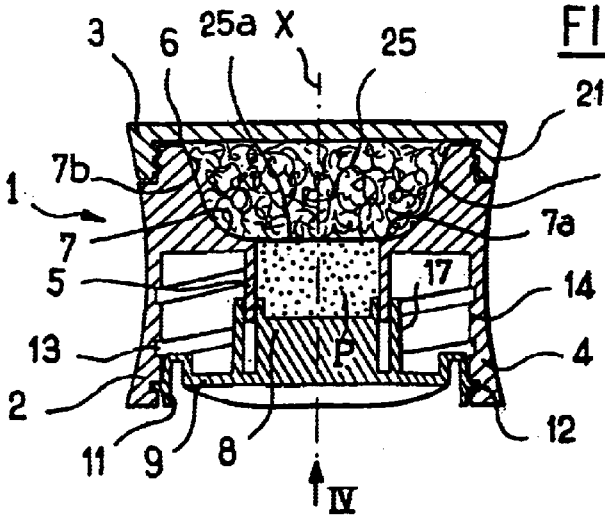
FIG. 3 is a diagrammatic axial section view of the device of FIGS. 1 and 2.

As can be seen in FIG. 3, the supply of substance P is contained in a chimney 5 of the body 2 that is substantially cylindrical about the axis X, constituting a first housing in the meaning of the invention.

The chimney 5 is made integrally with an outer skirt 4 by molding a plastics material, and its top end opens out into a housing 6 defined by an annular bearing surface 7 of the body 2 about the axis X, which bearing surface is generally concave towards the inside of the housing 6.

The housing 6 constitutes a second housing in the meaning of the invention.

The opening enabling the chimney 5 to communicate with the housing 6 is, in this case free from any auxiliary member and presents a cross-section that corresponds substantially to that of the chimney 5.

The supply of substance P is suitable for being moved along the axis X towards the housing 6 by a moving member 8, the moving member in the example described being secured to a drive member, in this example a disk-shaped base 9 provided with two resilient tabs 11 that are diametrically opposite.

Each of the tabs 11 has a stud 12 on its radially outer side that is suitable for engaging in a helical thread 13 recessed in the radially inner surface 14 of the outer skirt 4.

On its bottom face which the user can see, the base 9 has a diametral rib 16 enabling the user to turn it about the axis X so as to cause the moving member 8 to advance towards the housing 6.

A sealing skirt 17 surrounds the moving member 8, leaving an annular channel in which the chimney 5 can be engaged.

The sealing skirt 17 is connected to the base 9 and bears in leakproof manner against the chimney 5.

The body 2 has a thread 20 in its top portion and the cover 3 has a skirt 21 arranged to screw onto the body 2 and close the top portion of the receptacle in sealed manner.

The device 1 has an applicator which in the example described comprises an application portion 25 constituted in this case by an open-celled foam.

The application portion 25 is generally dome-shaped, and its base is of a diameter which is greater than the diameter of the chimney 5 in the body 2.

When the cover 3 is screwed onto the body 2, the application portion 25 bears against the bearing surface 7 so that the pressure exerted by the central zone 25*a* of the application portion 25 on the substance P is less than the pressure that would be exerted thereon in the absence of the bearing surface 7.

When the receptacle is closed, the application portion need not be in contact with the substance, for example if the moving member 8 is in a set-back position.

It will be observed that near the bottom of the bearing surface 7 it has an annular zone 7*a* from which the normal makes a relatively small angle relative to the axis X, and an angle that is smaller than 45°.

This annular zone 7*a* which surrounds the opening defined by the chimney 5 is pressed axially by the application portion 25.

The zone 7*b* of the bearing surface 7 which is situated above the above-mentioned zone 7*a* is of a shape that corresponds substantially to the shape of the application portion 25*b* in the vicinity of the base of its dome. In this way, this portion 25*b* is not compressed radially by said zone 7*b*.

To use the device 1, the user unscrews the cover 3 and then by turning the base 9 by means of its rib 16 causes the substance P to rise inside the housing 6.

The user can then fill the application portion 25 with substance, e.g. by causing it to turn a little in contact with the substance P.

When it is necessary to separate the moving member 8 from the body 2 of the receptacle, the user can bring the moving member 8 back into the low position and then move the flexible tabs 11 towards each other so as to disengage the studs 12 from the helical thread 13.

It should be observed that because of the contact that might exist between the central zone 25*a* of the application portion 25 and the substance P when the cover 3 is screwed onto the body 2, the action of unscrewing the cover 3 can, on its own, serve to fill the application portion 25 with substance.

Without going beyond the ambit of the present invention, it is possible to modify the way in which the cover 3 is fixed to the body 2 of the receptacle, for example by replacing the thread 20 by means of a single annular bead onto which the cover 3 snap-fastens.

It is also possible to provide any other conventional fastening means, for example a bayonet type fastening.

Figure 5:
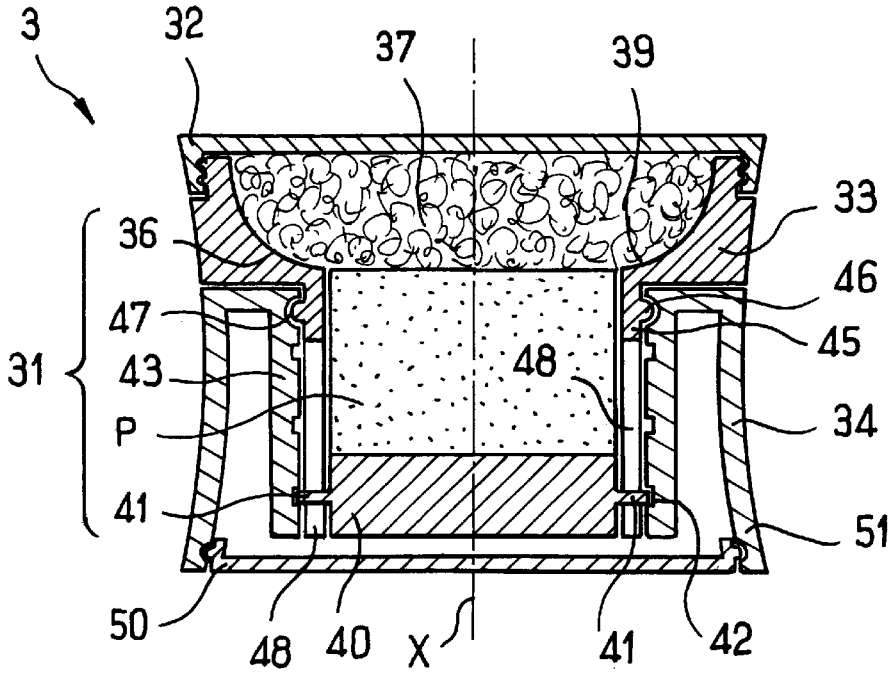
FIG. 5 is a diagrammatic axial section view of a device constituting a second embodiment of the invention.

In an alternate embodiment, the device has a drive mechanism comprised of a first and a second portion whose relative movement gives rise to axial displacement of the elevator member. For example, FIG. 5 shows a device 3 comprising a body 31 and a cover 32.

The body 31 has a top portion 33 and a bottom portion 34 capable of turning relative to each other about the axis X.

The top portion 33 defines a housing 36 to receive an application portion 37 of an applicator.

In the example described, the application portion 37 is secured to the cover 32 which serves as a handle member.

The housing 36 is defined by an annular bearing surface 39 that is concave towards the inside of the housing 36 and whose normal, close to its radially inner edge, is at a relatively small angle to the axis X, like the above-described bearing surface 7.

The substance P is carried by an elevator member 40 provided at its periphery with two diametrically-opposite studs 41 that engage in a thread 42 formed in the radially inner surface of a chimney 43.

The chimney 43 is formed integrally with an outer skirt 51.

The top portion 33 has a bushing 45 which extends inside the chimney 43.

The bushing 45 is provided with a bead 46 that snap-fastens in an annular groove 47 of the chimney 43 in such a manner as to allow the top and bottom portions 33 and 34 to rotate relative to each other without moving axially.

The bushing 45 also has two axial slots 48 in which the studs 41 can slide parallel to the axis X.

When the user turns the top portion 33 relative to the bottom portion 34, the bushing 45 turns the elevator member 40 and causes it to move axially, the studs 41 sliding in the slots 48.

The person skilled in the art can observe that the mechanism for driving the elevator member 40 is quite similar to that used in a lipstick case.

The bottom portion 34 is closed by a bottom 50 that is snapped onto the outer skirt 51.

To use the device 30, the user unscrews the cover 32 and then turns the top portion 33 relative to the bottom portion 34 so as to move the substance P towards the inside of the housing 36.

The user can then remove the substance P by means of the application portion 37.

Figure 6:
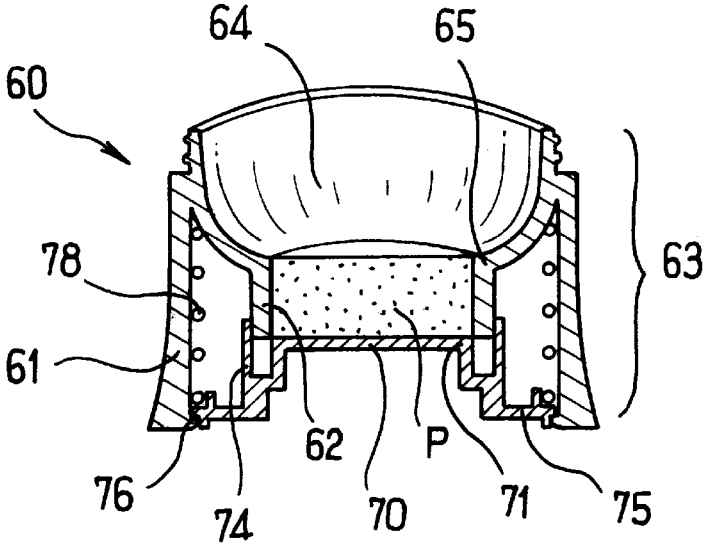
FIG. 6 is a diagrammatic axial section view of a device constituting a third embodiment of the invention, the applicator not being shown.

FIG. 6 shows a fragment of a device 60 constituting a third embodiment of the invention.

Like the devices 1 and 30 described above, the device 60 comprises a body 63 having an outer skirt 61 and a chimney 62 which receives a stick of substance P.

The body 63 of the device 60 has a housing 64 defined by a bearing surface 65 suitable for limiting the pressure that can be exerted by the application element (not shown) on the substance P, when the receptacle is closed in the absence of use.

The device 60 has an elevator member 70 enabling the substance P to be moved towards the inside of the housing 64.

In the embodiment described, the elevator member 70 has a piston-forming central portion 71 suitable for sliding in the chimney 62, and around said central portion 71 it has a sealing skirt 74 suitable for bearing in leakproof manner against the radially outer surface of the chimney 62, and it has a base 75 retained inside the outer skirt 61 by an annular abutment 76 formed at the bottom end of the outer skirt 61 on its radially inner side.

A spring 78 working in compression is received between the outer skirt 61 and the chimney 62 with its top end bearing against the web of the channel formed between the outer skirt 61 and the chimney 62, and with its bottom end bearing against the base 75.

Thus, at rest, the base 75 is urged against the annular abutment 76 by the spring 78.

To move the substance P towards the inside of the housing 64, the user bears on the outside face of the central portion 71.

Figure 7:
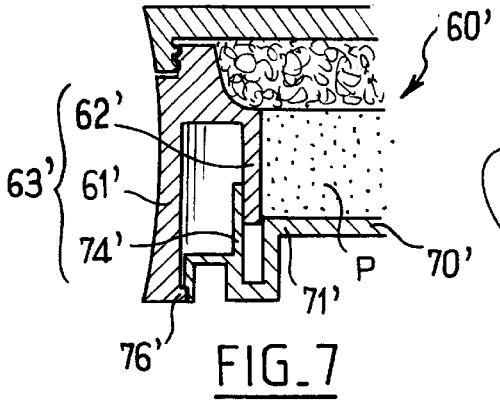
FIG. 7 is a fragmentary diagrammatic axial section of a device constituting a fourth embodiment of the invention.

FIG. 7 shows a device 60' that differs from the above-described device 60 essentially by the absence of the spring 78.

FIG. 7 uses the same reference digits as FIG. 6, associated with a prime symbol ', to designate elements that are identically or functionally analogous.

Figure 8:
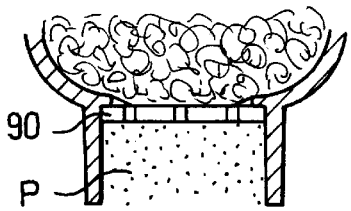
FIG. 8 is a fragmentary diagrammatic axial section showing a fifth embodiment of the invention.

The opening whereby the chimney communicates with the housing containing the application portion can receive a moving screen 90 as shown in FIG. 8, said screen 90 being capable of being moved relative to the body of the receptacle towards the supply of substance.

Figure 9:
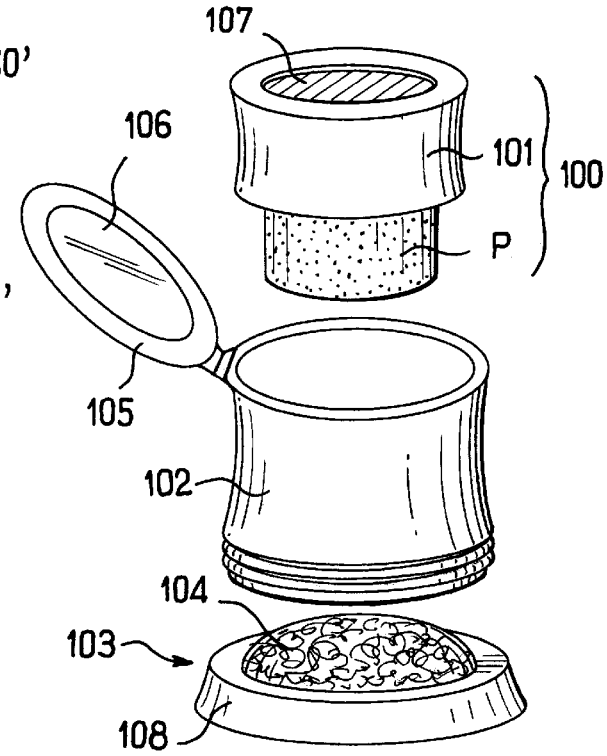
FIG. 9 is a diagrammatic perspective view of a device including a refill.

The supply of substance P can be contained in a refill 100 shown diagrammatically in FIG. 9, said refill comprising not only the supply of substance P, but also a substance-carrier unit 101, optionally including a drive mechanism for moving the substance P towards the application portion of the applicator.

The refill 100 is placed in a receptacle body 102 in which an applicator 103 is housed comprising an application portion 104 and a cover 108 that also serves as a handle member.

Figure 4:
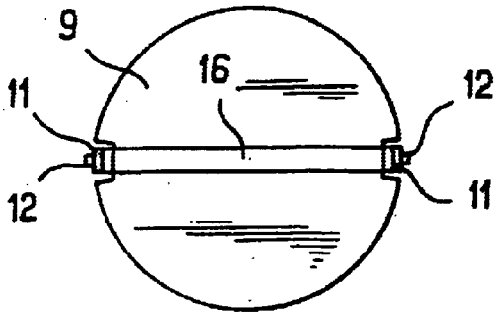
FIG. 4 is a view from beneath as seen along arrow IV of FIG. 3.

The moving member may be contained within the receptacle by at least one fastener capable of being moved by the user to release the moving member from the body of the receptacle, such that the moving member can be removed from the body and a refill moving member to be inserted. For example, the body 102 can have a hinged wall 105 so as to allow the refill 100 to be put into place in the body 102. Further, as depicted in FIGS. 3 & 4, the studs 12 of the base 9 are fasteners which secure the moving member 8 to the helical threads 13 recessed in the radially inner surface 14 of the outer skirt 4.

The end wall 105 can have an opening 106, e.g. enabling the user to drive the refill 100 so as to move the substance P towards the application portion 104.

In a variant, the opening 106 can reveal a mirror 107 fixed to the refill 100, or any other element, for example a sample of substance or a colored patch.

FIGS. 10 to 15 show various configurations for the application portion and/or the applicator.

Figure 10:
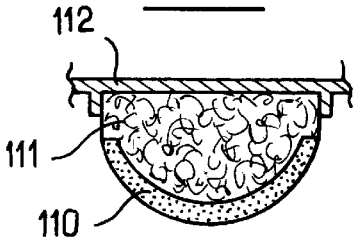
FIGS. 10 to 15 show various configurations for the applicator or the application element.

As shown in FIG. 10, the applicator can have an application portion 110 that is relatively rigid, being flied on an elastically deformable material, such as foam 111, the foam in turn being secured to a support made of rigid plastics material 112.

The foam 111 behaves like a resilient return member enabling the application portion 110 to be urged towards the supply of substance when the applicator is fixed on the receptacle.

Figure 11:
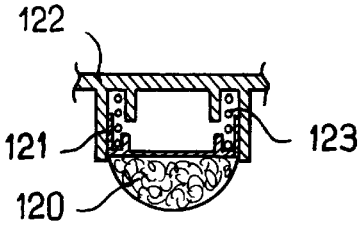

The application portion can also be mounted on a moving assembly as shown in FIG. 11.

In this figure, there can be seen the application portion 120 which is constituted by foam, and which is fixed to a moving assembly 121 that is movable relative to a support 122 against the action of a return spring 123.

The spring 123 enables the application portion 120 to be urged against the supply of substance when the applicator is in place on the receptacle.

The application portion can include materials of different kinds and/or structures.

Figure 12:
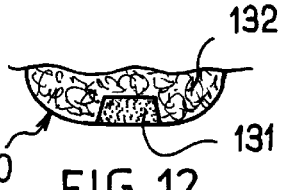

By way of example, FIG. 12 shows an application portion 130 comprising a central portion 131 made of a relatively flexible foam and a peripheral portion 132 extending around the central portion 131 and made of a foam that is stiffer.

Figure 13:
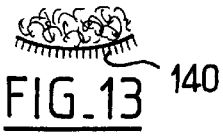

The application portion can have flocking 140 on its surface, as shown in FIG. 13.

Figure 14:
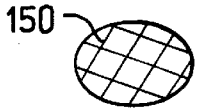

As shown in FIG. 14 in plan view, the application portion can also be covered by a net 150.

Figure 15:
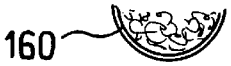

The application portion could also have a non-woven cloth layer 160 on its surface, as shown in FIG. 15.

Figure 16:
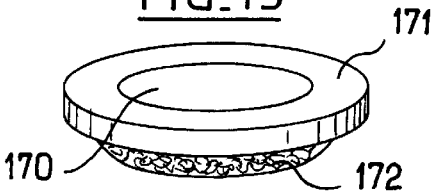
FIG. 16 is a diagram showing an applicator including a moving member enabling the application portion to be moved towards the supply of substance.

FIG. 16 shows the possibility of the applicator including a member 170 that moves inside a cover 171, enabling the application portion 172 to be moved towards the substance when the cover 171 is fixed on a receptacle body such as the body 102 in FIG. 9, for example.

Naturally, the invention is not limited to the embodiments described above.

In particular, the application element can be of a wide variety of kinds, textures, or structures, depending on the kind of makeup required, and it can optionally include biocidal agents, e.g. bactericides.

The substance can be in semisolid, cream, gell, or powder form, and it can be presented in the form of a stick, cast or compacted directly in the receptacle, or separately outside it and subsequently fitted therein.

The application portion can likewise be removable relative to the cover for closing the receptacle.

The application portion can be wetted prior to taking any substance.

What is claimed is:

1. A device comprising:

an applicator having an application portion and a receptacle capable of being closed, the receptacle defining a first housing for a substance and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said bearing surface limiting the pressure that can be exerted by the application portion on the substance when the receptacle is closed, said second housing having a cross-section increasing from the opening to a top aperture of the second housing, a normal of the bearing surface in the vicinity of the opening making an angle relative to an axis of the first housing which is smaller than 45°.

2. A device according to claim 1, wherein the bearing surface is annular in shape.

3. A device according to claim 2, wherein the bearing surface is integrally formed with a body of the receptacle.

4. A device according to claim 1, wherein the bearing surface is concave in shape towards the application portion.

5. A device according to claim 1, wherein the bearing surface is of a shape selected to enable it to match substantially the shape of a region of the application portion when the applicator is in place on the receptacle.

6. A device according to claim 1, wherein the application portion is secured to a handle member which also constitutes a cover for closing the receptacle.

7. A device according to claim 1, including a member that is movable in such a manner as to cause relative movement between the substance and the application portion.

8. A device according to claim 7, wherein the member is movable relative to the receptacle to drive the substance towards the application portion.

9. A device according to claim 8, wherein the member is secured to a drive member which is movable relative to a body of the receptacle by screw cooperation therewith, such that turning the drive member gives rise to axial displacement of the member in the body of the receptacle.

10. A device according to claim 9, wherein the drive member is (directly accessible by a user from outside the receptacle.

11. A device according to claim 10, wherein the drive member is in the form of a base having on a bottom face at least one portion in relief enabling it to be turned.

12. A device according to claim 8, including a drive mechanism enabling the moving member to be driven in axial displacement, said drive mechanism comprising a first portion and a second portion, which portions are movable relative to each other, the first portion having axial slots slidably receiving studs secured to the moving member, and the second portion having at least one thread in which said studs are engaged, such that relative movement between the two portions gives rise to axial displacement of the moving member.

13. A device according to claim 7, wherein the member is movable relative to the cover to drive the application portion towards the substance.

14. A device according to claim 7, wherein the member is suitable for being moved relative to a body of the receptacle toward the inside of the second housing merely by the user exerting pressure on the member.

15. A device according to claim 14, wherein the member is urged away from the inside of the second housing by a resilient return member.

16. A device according to claim 1, wherein the application portion is made of an elastically deformable material.

17. A device according to claim 16, wherein the application portion is secured to an elastically deformable member.

18. A device according to claim 1, wherein the application portion is made with a relatively rigid application surface, and wherein the applicator includes elastically deformable material enabling the application portion to be urged to move towards the substance.

19. A device according to claim 18, wherein the applicator includes a spring between the cover and the application portion.

20. A device according to claim 1, wherein the body of the receptacle is arranged in such a manner as to enable the device to be refilled.

21. A device according to claim 1, including a member which is removably disposed within a body of the receptacle.

22. A device according to claim 21, wherein the member is secured to at least one fastener capable of being moved by the user to release the member from the body of the receptacle.

23. A device according to claim 22, wherein the at least one fastener is resilient tabs having studs engaging in an inside thread of the body of the receptacle, the tabs being suitable for being moved by a user when it is necessary to separate the member from the body of the receptacle.

24. A device according to claim 1, wherein the body of the receptacle includes an end wall enabling a refill to be put into place.

25. A device according to claim 24, wherein said end wall is removable.

26. A device according to claim 24, wherein said end wall is hinged.

27. A device according to claim 24, wherein the end wall has a central opening.

28. A device according to claim 24, wherein the refill includes a supply of substance and a substance-carrier unit.

29. A device according to claim 28, wherein said substance-carrier unit includes a drive mechanism enabling the substance to be moved towards the application portion.

30. A device according to claim 1, containing a dispersible substance that is one state chosen among: semisolid, gel, cream, powder form.

31. A device according to claim 30, wherein the substance is in the form of a stick, cast or compacted directly in the body of the receptacle or fitted therein.

32. A device according to claim 1, wherein the receptacle closes in sealed manner.

33. A device according to claim 32, wherein the application portion contributes to sealing closure of the receptacle.

34. A device according to claim 1, wherein the application portion is dome-shaped with its base section being greater than the section of said opening.

35. A device according to claim 1, wherein the substance is dispensed towards the application portion through a screen disposed in said opening and slidably mounted in the first housing.

36. A device according to claim 1, wherein the application portion includes a foam having open or closed cells.

37. A device according to claim 1, wherein the application portion is covered by one covering chosen among: a flocking, a net, a woven cloth, a non-woven cloth.

38. A device according to claim 1, wherein the application portion includes at least one of: a plurality of elements of different structures, foams of different harnesses, densities, porosities.

39. A device comprising:

an applicator having an application portion and a receptacle capable of being closed, the receptacle defining a first housing for a substance and a second housing, which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said bearing surface limiting the pressure that can be exerted by the application portion on the substance when the receptacle is closed, said device including a member that is movable in such a manner as to cause relative movement between the substance and the application portion.

40. A device comprising:

an applicator having an application portion and a receptacle capable of being closed, the receptacle defining a first housing for a substance and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said application portion resting on said bearing surface when the receptacle is closed, said device comprising further:

a member that is movable in such a manner as to cause relative movement between the substance and the first housing independently of the applicator.

41. A device according to claim 40, wherein the member is movable relative to the receptacle to drive the substance towards the application portion.

42. A device according to claim 40, wherein it comprises a drive member which is movable relative to a body of the receptacle by screw co-operation therewith, such that turning the drive member gives rise to axial displacement of the member in the body of the receptacle.

43. A device according to claim 42, wherein the drive member is directly accessible by a user from outside the receptacle.

44. A device according to claim 42, wherein the drive member is in the form of a base having on a bottom face at least one portion in relief enabling it to be turned.

45. A device according to claim 40, including a drive mechanism enabling the member to be driven in axial displacement, said drive mechanism comprising a first portion and a second portion, which portions are movable relative to each other, the first portion having axial slots slidably receiving studs secured to the member, and the second portion having at least one thread in which said studs are engaged, such that relative movement between the two portions gives rise to axial displacement of the member.

46. A device comprising:

an applicator having an application portion secured to a cover and a receptacle capable of being closed by said cover, the receptacle defining a first housing for a substance and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said application portion resting on said bearing surface when the receptacle is closed.

47. A device according to claim 46, wherein the bearing surface is annular in shape.

48. A device according to claim 47, wherein the bearing surface is integrally formed with a body of the receptacle.

49. A device according to claim 46, wherein the bearing surface is concave in shape towards the application portion.

50. A device according to claim 46, including a member that is movable in such a manner as to cause relative movement between the substance and the application portion.

51. A device according to claim 50, wherein the member is secured to at least one fastener capable of being moved by the user to release the member from the body of the receptacle and allow a new supply of substance to be put into place.

52. A device according to claim 50, wherein the member is movable relative to the receptacle to drive the substance towards the application portion.

53. A device according to claim 52, wherein the member is movable relative to the cover to drive the application portion towards the substance.

54. A device according to claim 46, wherein the application portion is made of an elastically deformable material.

55. A device according to claim 46, wherein the applicator includes a spring between the cover and the application portion.

56. A device according to claim 46, wherein the receptacle closes in sealed manner.

57. A device according to claim 46, wherein the application portion is dome-shaped with its base section being greater than the section of said opening.

58. A device according to claim 46, wherein the substance is dispensed towards the application portion through a screen disposed in said opening and slidably mounted in the first housing.

59. A device comprising:

an applicator having an application portion and a receptacle capable of being closed, the receptacle defining a first housing for a substance and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said application portion resting on said bearing surface when the receptacle is closed, a surface of the substance extending over the entire opening being directly exposed to the second housing, said second housing having a cross-section increasing from the opening to a top aperture of the second housing, and a normal of the bearing surface in the vicinity of the opening making an angle relative to an axis of the first housing which is smaller than 45°.

60. A device according to claim 59, wherein the bearing surface is annular in shape.

61. A device according to claim 60, wherein the bearing surface is integrally formed with a body of the receptacle.

62. A device according to claim 59, wherein the application portion is secured to a handle member which also constitutes a cover for closing the receptacle.

63. A device according to claim 59, including a member that is movable in such a manner as to cause relative movement between the substance and the application portion.

64. A device according to claim 63, wherein the member is secured to a drive member which is movable relative to a body of the receptacle by screw co-operation therewith, such that turning the drive member gives rise to axial displacement of the member in the body of the receptacle.

65. A device according to claim 59, wherein the receptacle closes in sealed manner.

66. A device according to claim 59, wherein the application portion is dome-shaped with its base section being greater than the section of said opening.

67. A device comprising:

an applicator having an application portion and a receptacle capable of being closed, the receptacle defining a first housing for a substance and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said application portion resting on said bearing surface when the receptacle is closed, said first housing being filled by said substance exclusively, said second housing having a cross-section increasing from the opening to a top aperture of the second housing, a normal of the bearing surface in the vicinity of the opening making an angle relative to an axis of the first housing which is smaller than 45°.

68. A device according to claim 67, wherein the bearing surface is annular in shape.

69. A device according to claim 68, wherein the bearing surface is integrally formed with a body of the receptacle.

70. A device according to claim 67, wherein the application portion is secured to a handle member which also constitutes a cover for closing the receptacle.

71. A device according to claim 67, including a member that is movable in such a manner as to cause relative movement between the substance and the application portion.

72. A device according to claim 71, wherein the member is secured to a drive member which is movable relative to a body of the receptacle by screw co-operation therewith, such that turning the drive member gives rise to axial displacement of the member in the body of the receptacle.

73. A device according to claim 72, wherein the drive member is directly accessible by a user from outside the receptacle.

74. A device according to claim 67, wherein the receptacle closes in sealed manner.

75. A device according to claim 67, wherein the application portion is dome-shaped with its base section being greater than the section of said opening.

76. A device according to claim 67, wherein the substance is dispensed towards the application portion though a screen disposed in said opening and slidably mounted in the first housing.

77. A device comprising:

an applicator having an application portion and a receptacle capable of being closed, the receptacle defining a first housing for a substance and a second housing which, in a closed position of the receptacle, receives the application portion of the applicator, said first and second housings communicating via an opening of a cross-section that is substantially identical to that of the first housing and substantially smaller than a cross-section of the application portion, said opening enabling the application portion to be put into contact with the substance, said second housing defining a bearing surface around at least a portion of said opening, said applicator resting on said bearing surface when the receptacle is closed, said second housing having a cross-section increasing from the opening to a top aperture of the second housing, a normal of the bearing surface in the vicinity of the opening making an angle relative to an axis of the first housing which is smaller than 45°.

78. A device according to claim 77, wherein the bearing surface is annular in shape.

79. A device according to claim 78, wherein the bearing surface is integrally formed with a body of the receptacle.

80. A device according to claim 77, wherein the bearing surface is concave in shape towards the application portion.

81. A device according to claim 77, wherein the bearing surface is of a shape selected to enable it to match substantially the shape of a region of the application portion when the applicator is in place on the receptacle.

82. A device according to claim 77, wherein the application portion is (secured to a handle member which also constitutes a cover for closing the receptacle.

83. A device according to claim 77, including a member that is movable in such a manner as to cause relative movement between the substance and the application portion.

84. A device according to claim 83, wherein the member is movable relative to the receptacle to drive the substance towards the application portion.

85. A device according to claim 83, wherein the member is movable relative to the cover to drive the application portion towards the substance.

86. A device according to claim 83, wherein the member is secured to a drive member which is movable relative to the body of the receptacle by screw co-operation therewith, such that turning the drive member gives rise to axial displacement of the member in the body of the receptacle.

87. A device according to claim 86, wherein the drive member is directly accessible by a user from outside the receptacle.

88. A device according to claim 87, wherein the drive member is in the form of a base having on a bottom face at least one portion in relief enabling it to be turned.

89. A device according to claim 83, including a drive mechanism enabling the member to be driven in axial displacement, said drive mechanism comprising a first portion and a second portion, which portions are movable relative to each other, the first portion having axial slots slidably receiving studs secured to the member, and the second portion having at least one thread in which said studs are engaged, such that relative movement between the two portions gives rise to axial displacement of the member.

90. A device according to claim 83, wherein the member is suitable for being moved relative to the body of the receptacle merely by the user exerting pressure on the member.

91. A device comprising:

an applicator having an application portion and a receptacle capable of being closed, the receptacle defining a first housing for a substance and a second housing which, in a closed position of the receptacle, receives the application portion of the applicator, said first and second housings communicating via an opening, said opening enabling the application portion to be put into contact with the substance, said second housing defining a bearing surface around at least a portion of said opening, said applicator coming into contact with said bearing surface when the receptacle is closed, said device including a member that is movable in such a manner as to cause relative movement between the substance and the first housing, a surface of the product extending over the entire opening being directly exposed to the second housing.

92. A device according to claim 91, wherein the bearing surface is annular in shape.

93. A device according to claim 91, wherein the bearing surface is integrally formed with a body of the receptacle.

94. A device according to claim 1, including a member that is movable in such a manner as to cause relative movement between the substance and the application portion.

95. A device according to claim 94, wherein the member is movable relative to the receptacle to drive the substance towards the application portion.

96. A device according to claim 94, wherein the member is movable relative to the cover to drive the application portion towards the substance.

97. A device according to claim 94, wherein the member is secured to a drive member which is movable relative to the body of the receptacle by screw co-operation therewith, such that turning the drive member gives rise to axial displacement of the member in the body of the receptacle.

98. (currently amended) A device comprising:

an applicator having an application portion and a receptacle capable of being closed, the receptacle defining a first housing for a substance and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said application portion resting on said bearing surface when the receptacle is closed, said first housing comprising a base defining a bottom of the first housing, said base being configured to be moved relative to said opening.

99. A device according to claim 98, wherein the base is secured to a drive member which is movable relative to the body of the receptacle by screw co-operation therewith, such that turning the drive member gives rise to axial displacement of the bottom.

100. A device comprising an applicator having an application portion and a receptacle capable of being closed, the receptacle defining a first housing for a substance and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said application portion resting on said bearing surface when the receptacle is closed, the receptacle further including a member secured to a drive member which is operably connected to and movable relative to a body of the receptacle, such that application of force upon the drive member gives rise to axial displacement of the member in the body of the receptacle toward the application portion.

101. The device of claim 100, wherein the drive member is modified to include studs which are slidable within threads of an inner skirt of the body of the receptacle.

102. A device comprising an applicator having an application portion and a receptacle capable of being closed, the receptacle defining a first housing for a substance and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said application portion resting on said bearing surface when the receptacle is closed, the receptacle further including a member secured to a drive mechanism enabling the member to be driven in axial displacement, said drive mechanism comprising a first (portion and a second portion, which portions are operably connected and movable relative to each other around an axis, such that relative movement between the two portions gives rise to axial displacement of the member.

103. A device of claim 102, wherein the member is modified to include studs which are slidable within threads of the second portion of the receptacle.

104. A device of claim 102, wherein the body of the receptacle includes an end wall, said end wall being located at an end of the receptacle opposite of the opening.

105. A device of claim 102, further comprising a screen wherein the screen is slidable within a chimney of the first housing and wherein the screen is of a cross section greater than that of the opening.

106. A device comprising:

an applicator having an application portion and a receptacle capable of being closed, the receptacle defining a first housing for a substance and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said bearing surface limiting the pressure that can be exerted by the application portion on the substance when the receptacle is closed, the bearing surface being integrally formed with a body of the receptacle.

107. A device according to claim 106, wherein the bearing surface is annular in shape.

108. A device according to claim 106, wherein the bearing surface is of a shape configured to match substantially the shape of a region of the application portion when the applicator is in place on the receptacle.

109. A device according to claim 106, including a member that is movable in such a manner as to cause relative movement between the substance and the application portion.

110. A device according to claim 109, wherein the member is movable relative to the receptacle to drive the substance towards the application portion.

111. A device according to claim 109, wherein the member is suitable for (being moved relative to the body of the receptacle toward the inside of the second housing merely by the user exerting pressure on the member.

112. A device according to claim 109, wherein the member is urged away from the inside of the second housing by a resilient return member.

113. A device according to claim 106, wherein the substance is dispensed towards the application portion through a screen.

114. A device comprising:

an applicator having an application portion and a receptacle capable of being closed, the receptacle defining a first housing for a substance and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said application portion resting on said bearing surface when the receptacle is closed, the bearing surface being concave in shape towards the application portion.

115. A device according to claim 114, wherein the bearing surface is annular in shape.

116. A device according to claim 114, wherein the bearing surface is of a shape configured to match substantially the shape of a region of the application portion when the applicator is in place on the receptacle.

117. A device according to claim 114, including a member that is movable in such a manner as to cause relative movement between the substance and the application portion.

118. A device according to claim 114, wherein the application portion is dome-shaped with its base section being greater than the section of said opening.

119. A device according to claim 114, wherein the (substance is dispensed towards the application portion through a screen.

120. A device according to claim 114, wherein the body of the receptacle includes an end wall enabling a refill to be put into place.

121. A device comprising:

an applicator having an application portion and a receptacle capable of being closed, the receptacle defining a first housing for a substance and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said application portion resting on said bearing surface when the receptacle is closed, the application portion being made with relatively rigid application surface, and the applicator including elastically deformable material enabling the application portion to be urged to move towards the substance.

122. A device according to claim 121, the device further comprising a cover for closing the receptacle and the applicator including a spring between the cover and the application portion.

123. A device comprising:

an applicator having an application portion and a receptacle capable of being closed, the receptacle defining a first housing for a substance and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said application portion resting on said bearing surface when the receptacle is closed, the application portion being secured to an elastically deformable member.

124. A device according to claim 123, wherein the application portion is made of an elastically deformable material.

125. A device comprising:

an applicator having an application portion and a receptacle capable of being closed, the receptacle defining a first housing for a substance and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said application portion resting on said bearing surface when the receptacle is closed, the device including a member which is removably disposed within a body of the receptacle, said member being secured to at least one fastener capable of being moved by the user to release the member from the body of the receptacle.

126. A device according to claim 125, wherein the at least one fastener is resilient tabs having studs engaging in an inside thread of the body of the receptacle, the tabs being suitable for being moved by a user when it is necessary to separate the member from the body of the receptacle.

127. A device according to claim 125, wherein the body of the receptacle includes an end wall enabling a refill to be put into place.

128. A device according to claim 127, wherein the end wall has a central opening.

129. A device according to claim 127, wherein the refill includes a supply of substance and a substance-carrier unit.

130. A device according to claim 129, wherein said substance-carrier unit includes a drive mechanism enabling the substance to be moved towards the application portion.

131. A device according to claim 127, wherein said end wall is removable.

132. A device according to claim 127, wherein said end wall is hinged.

133. A device comprising:

an applicator having an application portion including a foam and a receptacle capable of being closed, the receptacle defining a first housing for a substance and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said bearing surface limiting the pressure that can be exerted by the application portion on the substance when the receptacle is closed.

134. A device comprising:

an applicator having an application portion and a receptacle capable of being closed, the receptacle defining a first housing for a substance and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said bearing surface limiting the pressure that can be exerted by the application portion on the substance when the receptacle is closed, said application portion being covered by at least one of:

a flocking, a net, a woven cloth, and a non-woven cloth.

135. A device comprising:

an applicator having an application portion and a receptacle capable of being closed, the receptacle defining a first housing for a substance and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said bearing surface limiting the pressure that can be exerted by the application portion on the substance when the receptacle is closed, the application portion including at least one of a plurality of elements of different structures, foams of different hardnesses, densities or porosities.

136. A device comprising:

an applicator having an application portion and a receptacle capable of being closed, the receptacle defining a first housing for a substance and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said application portion resting on said bearing surface when the receptacle is closed, said second housing being configured so that a face of said applicator situated opposite to said first housing is not in contact with said second housing, a normal to the bearing surface in the vicinity of the opening making an angle relative to an axis of the first housing which is smaller than 45°.

137. A device according to claim 136, wherein the bearing surface is annular in shape.

138. A device according to claim 136, wherein the bearing surface is of a shape configured to match substantially the shape of a region of the application portion when the applicator is in place on the receptacle.

139. A device according to claim 136, including a member that is movable in such a manner as to cause relative movement between the substance and the application portion.

140. A device according to claim 139, wherein the member is movable relative to the receptacle to drive the substance towards the application portion.

141. A device according to claim 139, wherein the member is movable relative to the cover to drive the application portion towards the substance.

142. A device according to claim 139, wherein the member is suitable for being moved relative to a body of the receptacle toward the inside of the second housing merely by the user exerting pressure on the member.

143. A device according to claim 142, wherein the member is urged away from the inside of the second housing by a resilient return member.

144. A device according to claim 139, wherein the bearing surface is at an inner periphery substantially perpendicular to the axis of the first housing.

145. A device according to claim 136, wherein the substance is dispensed towards the application portion through a screen.

146. A device comprising:

an applicator having an application portion and a receptacle capable of being closed, the receptacle comprising a tubular wall extending along an axis and having an external surface having a transverse dimension in a plane perpendicular to said axis and an internal surface defining a first housing for a substance, and a second housing which, in a closed position of the receptacle, receives the application portion of the applicator, said first and second housings communicating via an opening of a cross-section that is substantially identical to that of the first housing, said opening enabling the application portion to be put into contact with the substance, said second housing defining a bearing surface around at least a portion of said opening, said bearing surface limiting the pressure that can be exerted by the application portion on the substance when the receptacle is closed, said second housing being configured so that a face of said applicator situated opposite to said first housing is not in contact with said second housing, the applicator having, in a plane perpendicular to said axis, a cross-section having a maximum which is greater than said transverse dimension of said tubular wall.

147. A device according to claim 146, wherein the bearing surface is annular in shape.

148. A device according to claim 146, wherein the bearing surface is of a shape configured to match substantially the shape of a region of the application portion when the applicator is in place on the receptacle.

149. A device according to claim 146, including a member that is movable in such a manner as to cause relative movement between the substance and the application portion.

150. A device according to claim 149, wherein the member is movable relative to the receptacle to drive the substance towards the application portion.

151. A device according to claim 149, wherein the member is movable relative to the cover to drive the application portion towards the substance.

152. A device according to claim 149, wherein the member is suitable for being moved relative to a body of the receptacle toward the inside of the second housing merely by the user exerting pressure on the member.

153. A device according to claim 152, wherein the member is urged away from the inside of the second housing by a resilient return member.

154. A device according to claim 146, wherein the substance is dispensed towards the application portion through a screen.

* * * * *